US011998078B2

(12) United States Patent
Cox

(10) Patent No.: US 11,998,078 B2
(45) Date of Patent: Jun. 4, 2024

(54) TWO-PIECE CHIN STRAP PAD

(71) Applicant: Alana Cox, Savannah, GA (US)

(72) Inventor: Alana Cox, Savannah, GA (US)

( * ) Notice: Subject to any disclaimer, the term of this patent is extended or adjusted under 35 U.S.C. 154(b) by 57 days.

(21) Appl. No.: 18/052,705

(22) Filed: Nov. 4, 2022

(65) Prior Publication Data

US 2024/0148096 A1 May 9, 2024

(51) Int. Cl.
*A42B 3/08* (2006.01)

(52) U.S. Cl.
CPC ..... *A42B 3/08* (2013.01)

(58) Field of Classification Search
CPC ..... A43B 3/08; A43B 3/005; B60R 2022/006
USPC ..... D29/105, 122
See application file for complete search history.

(56) References Cited

U.S. PATENT DOCUMENTS 2,546,859 A * 3/1951 Innes ..... G04B 37/005 63/3
2,867,811 A * 1/1959 Jones ..... A42B 3/08 2/9
3,916,446 A * 11/1975 Gooding ..... A42B 3/08 2/421
4,051,556 A * 10/1977 Davenport ..... A42B 3/08 2/421
4,398,306 A 8/1983 Gooding
4,646,368 A * 3/1987 Infusino ..... A42B 3/08 2/421
4,651,356 A * 3/1987 Zide ..... A42B 3/08 2/421
4,706,305 A 11/1987 Cho
4,741,054 A * 5/1988 Mattes ..... A42B 3/08 2/421
5,488,441 A * 1/1996 Pomatti ..... G02C 3/003 2/452
5,595,332 A 1/1997 Freedman
5,598,588 A * 2/1997 Lee ..... A42C 2/002 2/421
5,685,020 A * 11/1997 Powell ..... A42B 3/08 2/421
5,794,274 A * 8/1998 Kraemer ..... A42B 3/08 2/9
5,911,315 A * 6/1999 Flowers ..... A42B 3/08 2/421
5,946,735 A * 9/1999 Bayes ..... A42B 3/08 24/442
6,081,932 A * 7/2000 Kraemer ..... A42B 3/08 2/421
6,088,840 A * 7/2000 Im ..... A42B 3/324 2/DIG. 2
6,324,701 B1 * 12/2001 Alexander ..... A42B 3/08 2/421

(Continued)

*Primary Examiner* — Heather Mangine
(74) *Attorney, Agent, or Firm* — Southeast IP Group LLC; Thomas L. Moses

(57) ABSTRACT

A two-piece chin strap pad for helmets and the like is generally oval shaped, and is split roughly evenly down the middle to form two pieces, or halves. Each half of the chin strap pad includes a hole or slot, so that a coupling member and/or a strap may fit therethrough. Additionally, each half of the chin strap pad may include corresponding hook and loop fastening material, or other temporary fastening means, so that the halves of the chin strap pad may be temporarily joined together when the coupling members are engaged.

6 Claims, 5 Drawing Sheets

(56) References Cited

U.S. PATENT DOCUMENTS 6,364,186 B1 * 4/2002 Gilmour ..... A45F 3/02 224/660
D526,449 S 8/2006 Dawson et al.
7,895,677 B1 * 3/2011 Schiebl ..... A42B 3/08 2/421
8,621,671 B1 * 1/2014 Schiebl ..... A42B 3/205 2/421
9,095,182 B1 * 8/2015 Rochholz ..... A42B 3/08
9,238,424 B1 * 1/2016 Foster ..... B60N 2/2881
9,345,281 B1 * 5/2016 Schiebl ..... A42B 3/205
D818,650 S * 5/2018 Lamson ..... D29/122
11,331,558 B2 5/2022 Tryner et al.
2007/0083986 A1 * 4/2007 Kaiser ..... A42B 3/08 2/410
2007/0124842 A1 * 6/2007 Nascimento ..... A42B 3/08 2/9
2009/0265841 A1 * 10/2009 Ferrara ..... A42B 3/08 2/421
2012/0028539 A1 * 2/2012 McCarty ..... A41F 1/006 450/1
2013/0042445 A1 * 2/2013 Perreault ..... A42B 3/08 24/616
2013/0152281 A1 * 6/2013 Kravitz ..... A42B 3/205 2/421
2014/0068844 A1 * 3/2014 Infusino ..... A42B 3/08 2/421
2015/0033455 A1 * 2/2015 Beauchamp ..... A42B 3/127 2/421
2015/0246626 A1 * 9/2015 Berger ..... B60N 2/2812 29/401.1
2018/0297551 A1 * 10/2018 Coakley ..... B60R 22/024
2019/0350296 A1 * 11/2019 Sanders ..... A42B 3/08
2019/0357619 A1 * 11/2019 Lamson ..... A42B 3/06
2020/0229516 A1 * 7/2020 Curran ..... A41D 1/06
2022/0225719 A1 * 7/2022 Kaiser ..... A42B 3/08
2023/0302976 A1 * 9/2023 Miskic ..... B60N 2/2816
2023/0371641 A1 * 11/2023 Hermansen ..... A42B 3/08

* cited by examiner

TWO-PIECE CHIN STRAP PAD

FIELD OF THE INVENTION

The present invention relates to pads for helmet chin straps. More specifically, the present invention includes a two-piece chin strap pad that can be separated into two halves, wherein each half may be attached to corresponding coupling members, so that when the coupling members are uncoupled, each half of the chinstrap pad is retained on the corresponding half of the coupling members. When the coupling members are engaged together, the chin strap may pieces may be removably connected via hook and loop fasteners, or the like.

BACKGROUND OF THE INVENTION

Recreational helmets are used for many sports and activities today. In particular, such activities where helmets are either recommended or required include bicycling, football, motorcycling, hockey, snow skiing, skateboarding, snowboarding, and the like. Most helmets include some type of chin strap, and common chin straps typically include quick connect coupling members. Oftentimes, the straps extend downwardly from the helmet, and connect to one another at a position underneath a wearer's chin, which is why the straps are often referred to as "chin straps."

One issue with chin straps is that the coupling members or buckles tend to be uncomfortable when worn, because they rub and chafe the skin beneath a wearer's chin. Further, snapping the coupling members together can often pinch the adjacent skin, which can create pain and discomfort. In order for the helmet to be effective in protecting a wearer's head, and to prevent concussions and the like, the chin straps need to be relatively tight, so that the helmet is maintained in its proper position on a wearer's head. This requirement is especially true when the wearer suffers a jarring impact against the helmet. If the chin straps are not tightly and properly secured, then the helmet may fail to remain in the proper position, thereby exposing the wearer to serious head injury.

When the chin straps and/or coupling members begin to irritate the skin under a wearer's chin, sometimes the wearer loosens the chin strap in order to get some relief from the chafing and rubbing. However, loosening the chin straps carries the risk that the helmet may come off of the wearer's head, or be improperly positioned at the very moment when the helmet is needed the most: in the event of an accident, collision, or the like.

Therefore, it would be desirable to provide a simple solution, such as a cushion or pad that could be fitted over each side of the coupling members, and which would be positioned between the coupling members and a wearer's chin, to provide a more comfortable way to engage the chin straps while ensuring that the chin straps are properly holding the helmet firmly in place. It would also be desirable to provide such a cushion or pad that requires little effort on the part of the wearer, so that the cushion or pad need not be adjusted each time the wearer engages or disengages the coupling members.

Many attempts to overcome these problems have been attempted, with varying levels of success, but none have been wholly satisfactory. The following documents provide examples of such efforts, and each of the following documents are hereby incorporated herein by reference, in their entireties:

U.S. Pat. No. 4,398,306 Chin Strap Safety Attachment for Protective Headgear

A chin strap safety attachment including a high impact resistant rigid anchor insert mounted upon a chin strap of the protective headgear. The anchor insert has a tongue which is shaped so as to be insertable into an opening in a coating anchor plate when the anchor insert is rotated from its normal locking position in engagement with the anchor plate. A Lift-the-Dot fastener, adjustably mounted on the free end of the chin strap adjacent the anchor insert, engages the anchor plate to provide additional securance of the chin strap.

U.S. Pat. No. 4,646,368 Adjustable Chin Strap Assembly for Athletic Helmets

This invention relates to an adjustable chin strap assembly for use with athletic helmets. The chin strap assembly consists of a flexible piece of material which forms the chin cup, two support straps slideably attached to this chin cup, two adjustment pieces through which the support straps slideably intersect, and a set of four slideable snaps which releasibly fasten the support straps to an athletic helmet. The attitude of the flexible chin cup can be adjusted by sliding the adjustment piece along the lengths of the support straps to each side of the chin cup thereby allowing for maximum user comfort.

U.S. Pat. No. 4,651,356 Helmet Chin Strap

A unitized chin strap for football helmets and the like is molded from an elastomer possessing elastic memory. The device includes a protective chin cup which is curved on two axes and is adapted to receive an apertured chin cushioning pad which allows the tip of the chin to be safely suspended in a space defined by the chin strap cup. The cup gradually diminishes in thickness and rigidity from the center of the cup toward its marginal edge. Divergent axis relatively flexible and somewhat stretchable straps are joined to the sides of the chin cup by relatively wide twist-resistant strap-to-cup joint portions. Conventional buckles having snap fastener components are slidably engaged on the straps of the device to provide a secure four point attachment of the chin strap to a helmet. The device substantially eliminates movement of the helmet on the head during use, thereby greatly reducing the likelihood of severe injury.

U.S. Pat. No. 5,595,332 Strap Cover and Method of Making the Same

Cover for securing about a strap of a strap-bearing device and method of forming the same including a sleeve for receiving the strap therein and a support layer for cushioning the strap against the user, the sleeve and support layer being made from a single piece of material.

U.S. Pat. No. 5,685,020 Bicycle Helmet with Chin Guard and Easy-Adjust Strap System Protective headgear with adjustable strap system and chin guard includes a first strap secured at its opposite ends to opposite sides of the headgear and adapted to extend downwardly therefrom to beneath the jaw of a person wearing the headgear, and a second strap secured at its opposite ends to opposite rear portions of the headgear and adapted to extend forwardly to and in front of the chin of a person wearing the headgear. The first and second straps are connected with first and second coupling members, respectively, at opposite sides of the strap system, connecting the first and second straps together where they intersect. The coupling members are fixed relative to the first strap and are slidable along the second strap, and one of the coupling members includes a quick-disconnect fitting to enable the first strap to be disconnected between its ends to enable the helmet to be quickly and easily applied to and removed from the head of a person using the headgear. The second strap is adjustable in length, and the chin guard is slidably adjustable along the second strap to enable it to be accurately positioned after the length of the first and second straps are adjusted.

U.S. Pat. No. 6,081,932 Chin Strap Assembly for Use with an Athletic Helmet

The chin strap assembly for use with an athletic helmet includes a chin cup member having a flexible strap on each side of the chin cup member, each flexible strap passing through a plurality of slots formed in the chin cup member.

U.S. Pat. No. 6,324,701 Chin Strap System

A chin strap system a pair of elongate straps and a substantially rigid cup anatomically configured for receiving a chin of a user. Four apertures extend between an inner and outer surface of the cup for receiving the straps. The straps are adjustably positionable through the apertures so that the straps crisscross one another adjacent the outer surface of the cup between the apertures. Each strap has a pair of free ends extending in opposite directions from the cup and include fasteners operatively for fastening the straps to a helmet with which the strap is to be used.

SUMMARY OF THE INVENTION

In one embodiment, the present invention includes a two-piece chin strap pad that is designed to be removably attached to engageable chin strap coupling members. Helmets typically have a pair of chin straps, and at the end of the straps, coupling members are attached thereto. The coupling members typically include a quick-connect mechanism, such as a male coupling member and a female coupling member. The male coupling member is inserted into a receiving portion of a female coupling member, and snaps into place securely. In order to disengage the coupling members from one another, a user may squeeze the outer portions of the male coupling member, which allows the user to remove the male coupling member from the female coupling member. The present invention includes a chin strap pad comprising two pieces, so that one piece may fit over the male coupling member, and the other piece may fit over the female coupling member. Each piece, or half, of the chin strap pad defines a hole, so that the coupling member and strap may slide through the hole. Preferably, each half of the chin strap pad also includes hook and loop fastening material, so that the halves of the chin strap pad may be temporarily affixed together while the coupling members are engaged together. In this way, the chin strap pad may be positioned between the coupling members and a wearer's chin, and the coupling members may be continually engaged and disengaged while the chin strap pad remains in place. This arrangement obviates the need for a wearer to adjust the positioning of the chin strap pad each time the coupling members are either engaged or disengaged.

BRIEF DESCRIPTION OF THE DRAWINGS

The drawings and specific descriptions of the drawings, as well as any specific or alternative embodiments discussed, are intended to be read in conjunction with the entirety of this disclosure. The tire and wheel lift assistance assembly may, however, be embodied in many different forms and should not be construed as being limited to the embodiments set forth herein; rather, these embodiments are provided by way of illustration only and so that this disclosure will be thorough, complete and fully convey understanding to those skilled in the art.

DETAILED DESCRIPTION OF THE INVENTION

Figure 1:
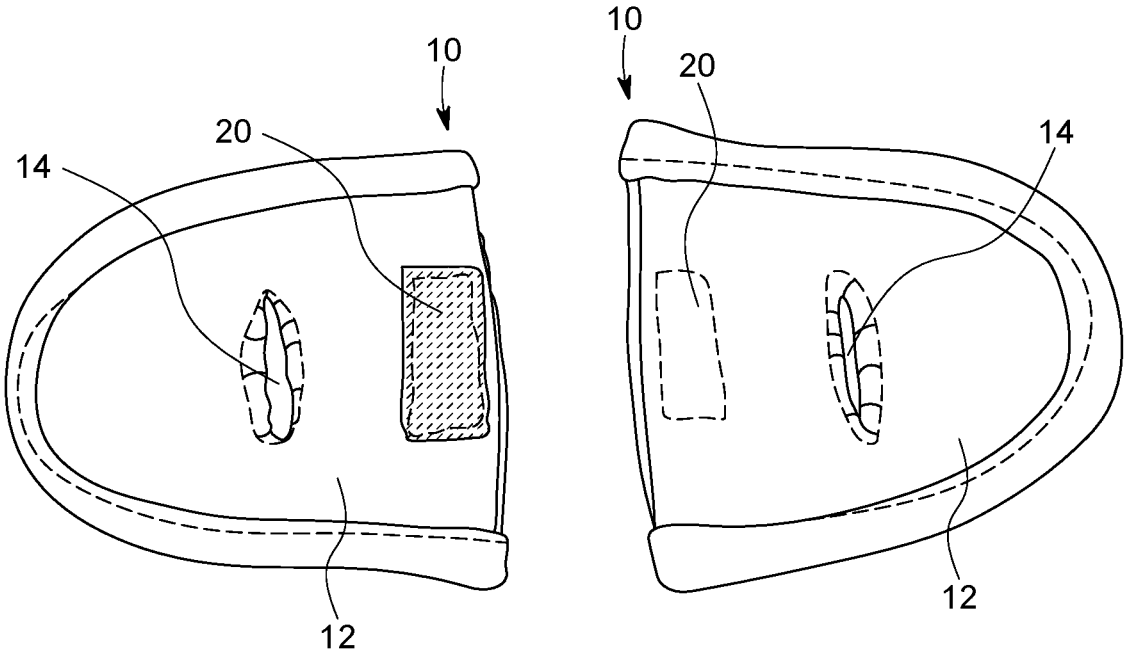
FIG. 1 is a top view of one embodiment of a two-piece chin strap pad, wherein the pad is formed from two half pads, with each half pad defining a slot for receiving a strap member, and further showing complementary hook and loop fastening material applied to the top of one half pad, and applied to the bottom of the second half pad.
Figure 2:
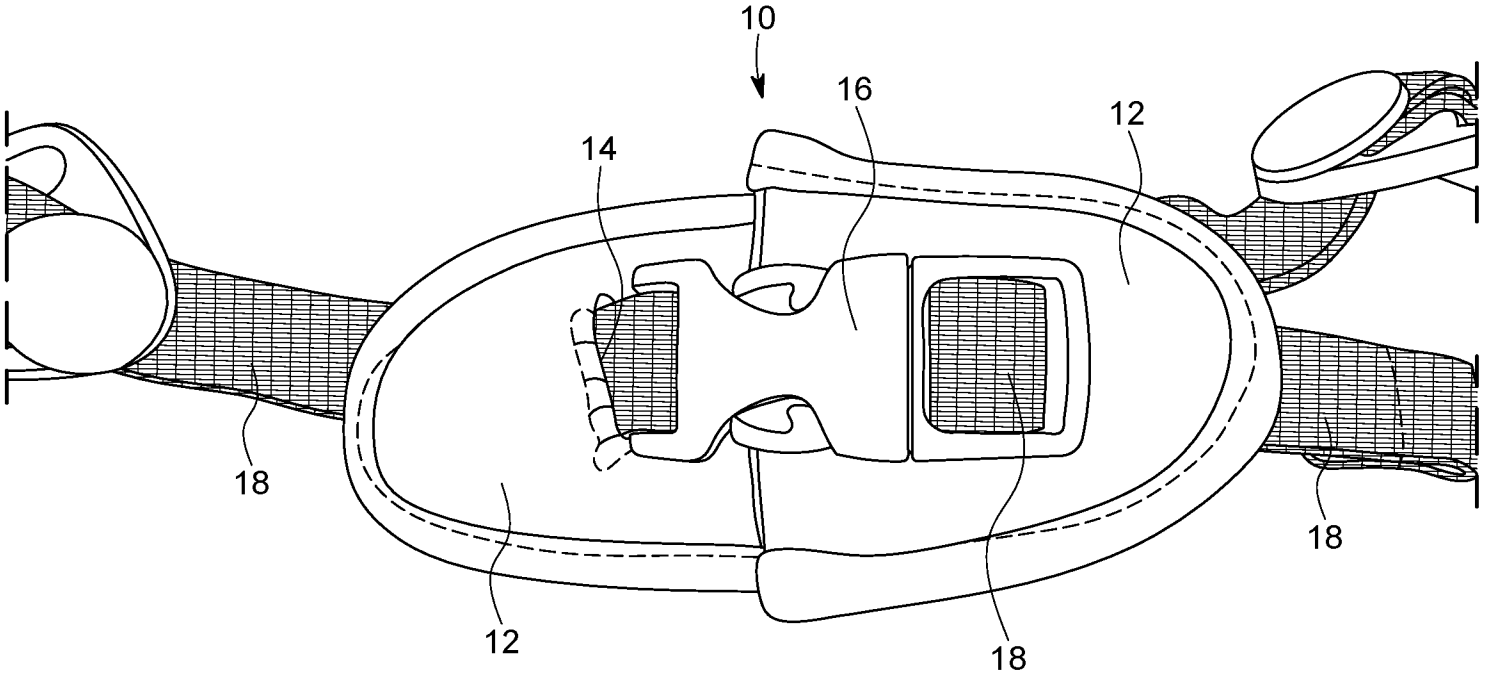
FIG. 2 is a front view of one embodiment of the two-piece chin strap pad as shown in FIG. 1, wherein the two-piece chin strap pad is slidably engaged with a pair of chin straps that are joined together by coupling means, and showing the chin strap pad halves fastened together by the hook and loop fastening material so that the chin strap pad covers one side of the coupling means to protect a user's chin and the skin therearound.
Figure 3:
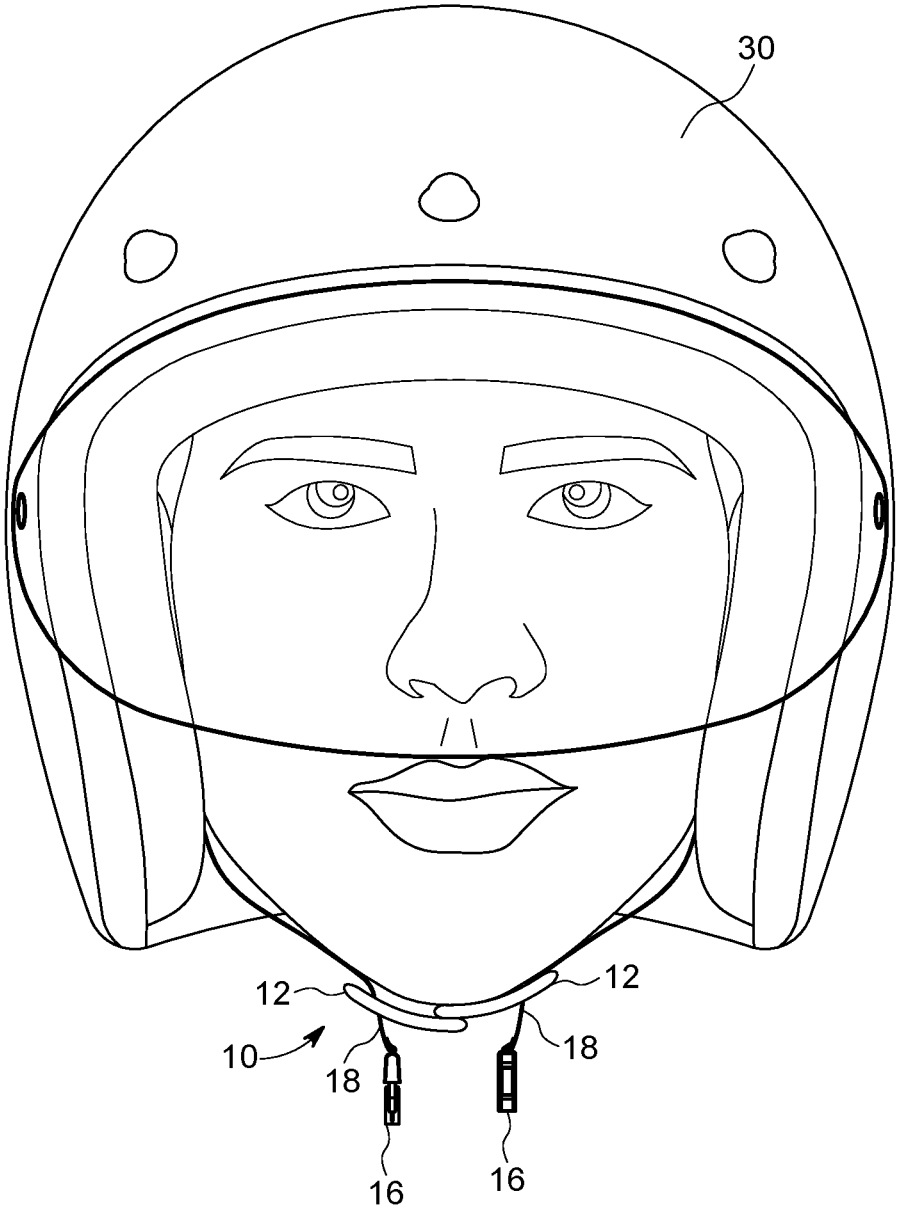
FIG. 3 is a front view of one embodiment of the two-piece chin strap pad, shown in use attached to straps of a user's helmet, wherein the coupling means are disengaged, and wherein the two-pieces of the chin strap pad are connected together by hook and loop fastening material.

The present invention includes, in a first embodiment as shown in FIGS. 1-5, a two-piece chin strap pad 10 for helmets and the like. In a preferred embodiment, the chin strap pad 10 is generally oval shaped, and is split roughly evenly down the middle to form two pieces, or halves 12. Each half 12 of the chin strap pad 10 includes a hole or slot 14, so that a coupling member 16 and/or a strap 18 may fit therethrough, as shown in FIG. 1. Additionally, each half 12 of the chin strap pad 10 may include corresponding hook and loop fastening material 20, so that the halves 12 of the chin strap pad 10 may be temporarily joined together when the coupling members 16 are engaged. It should be understood that other temporary attachment means may be used instead of hook and loop fastening material. For instance, snaps, buttons, clasps, or any other fastening means may be used to removably attach the two chin strap pad halves 12 together.

Figure 4:
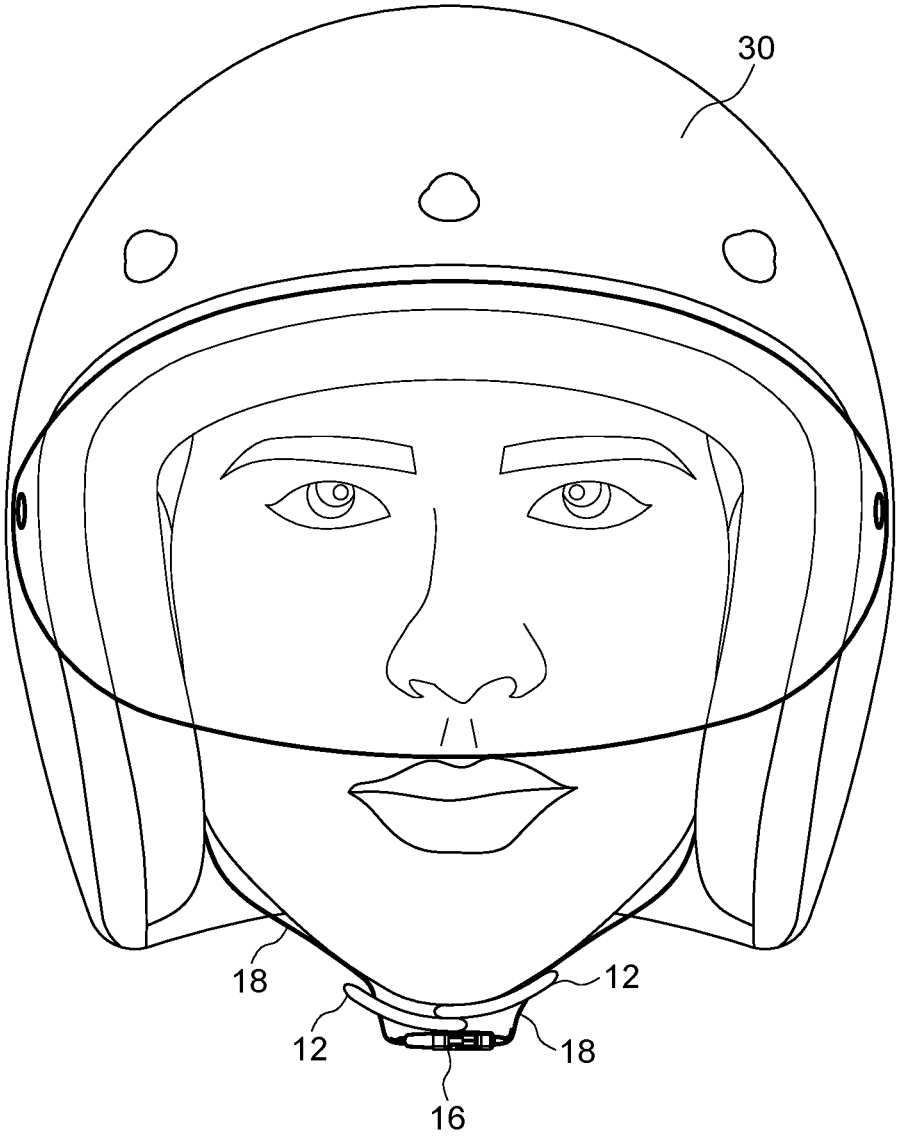
FIG. 4 is a front view of one embodiment of the two-piece chin strap pad, shown in use attached to straps of a user's helmet, wherein the coupling means are engaged underneath a user's chin, and wherein the two-pieces of the chin strap pad are connected together by hook and loop fastening material.
Figure 5:
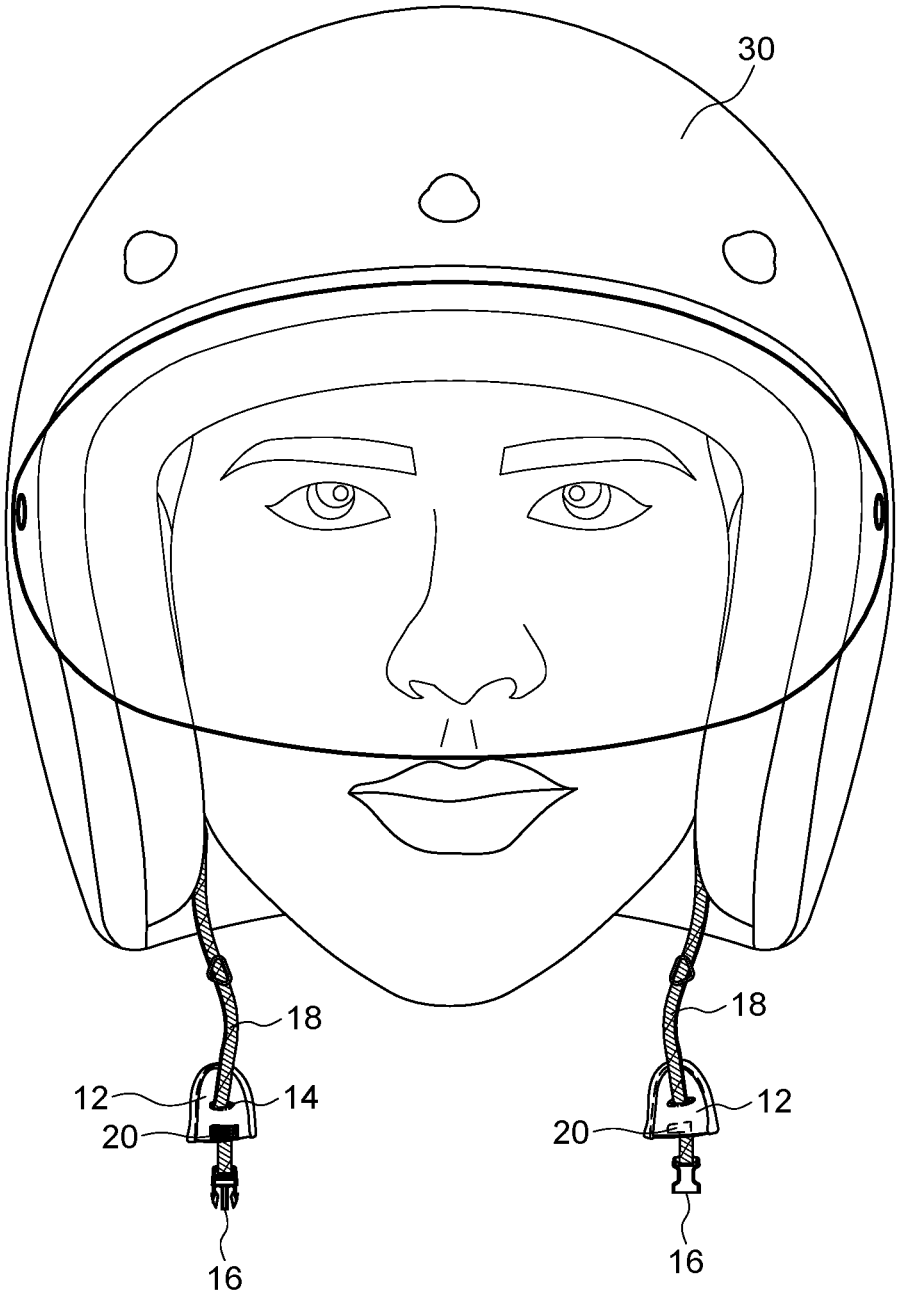
FIG. 5 is a front view one embodiment of the two-piece chin strap pad, shown in use attached to straps of a user's helmet, wherein the coupling means are disengaged from one another, and wherein the two-pieces of the chin strap pad are attached to corresponding straps, adjacent the coupling means.

To use the two-piece chin strap pad 10, a wearer simply slides the coupling member 16 through the hole or slot 14 in one of the halves 12 of the chin strap pad 10, and then slides the other coupling member 16 through the slot 14 in the other half 12 of the chin strap pad 10, as shown in FIGS. 2-5. Once each strap 18 extends through the slot 14 in the corresponding half 12 of the chin strap pad 10 so that the pad halves 12 are slidably engaged with the straps 18, the wearer may position the helmet 30 on his or her head. The wearer may then position the chin strap pad 10 (both halves 12) so that it is situated between the coupling members 16 and the wearer's chin, and may then join the coupling members 16 together, as shown in FIG. 4. The user may also apply the hook and loop fasteners 20 (or other fastening means) together, so that the chin strap halves 12 are temporarily attached to one another. Because the chin strap pad 10 is slidably engaged with the straps 18, it is possible to make minor adjustments to the position of the chin strap pad 10 while the coupling members 16 are joined together, if necessary.

When the coupling members 16 are disengaged, the halves 12 of the chin strap pad 10 may similarly be disengaged, so that one half pad 12 stays slidably engaged with the strap 18 having the male coupling member 16, and the other half pad 12 stays slidably engaged with the strap 18 having the female coupling member 16, as shown in FIG. 6.

It should be understood that the chin strap pad 10 may be made from any suitable types of material or combinations of materials, including neoprene, foam, polymeric materials, and the like. One advantage of the present invention is that the chin strap pad 10 is interchangeable with different helmets 30, different types of helmets, and of course, it may be used in other applications besides chin straps 18. Additionally, another advantage is that the chin strap pad 10 of the present invention may be removed for washing or cleaning.

Although the present invention has been described in considerable detail with reference to certain preferred versions thereof, other versions are possible. Therefore, the spirit and scope of the appended claims should not be limited to the description of the preferred versions contained herein. All features disclosed in this specification may be replaced by alternative features serving the same, equivalent or similar purpose, unless expressly stated otherwise. Thus, unless expressly stated otherwise, each feature disclosed is one example only of a generic series of equivalent or similar features.

The invention claimed is:

1. A two-piece chin strap pad comprising:

a first half pad defining a first distinct piece of the two-piece chin strap pad, the first half pad comprising a first hole for receiving a first strap through the first hole;

a second half pad defining a second distinct piece of the two-piece chin strap pad, the second half pad comprising a second hole for receiving a second strap through the second hole; and wherein said first half pad and said second half pad each include respective attachment means for temporary attachment of said first half pad to said second half pad; and wherein the first half pad has a first perimeter defined by a first edge and a second edge, the first edge being curved and having a longer length than the second edge;

wherein the second half pad has a second perimeter defined by a third edge and a fourth edge, the third edge being curved and having a longer length than the fourth edge;

wherein, when the first half pad and the second half pad are attached to one another, the first edge and the third edge define an outer perimeter for the two-piece chin strap pad, and the second edge and the fourth edge being overlapped with one another in a direction transverse to a longitudinal length of the two-piece chin strap pad.

2. The two-piece chin strap pad set forth in claim 1, wherein said respective attachment means includes hook and loop fastening material.

3. A method for protecting a helmet wearer's chin comprising the steps of:

providing a two-piece chin strap pad, wherein said chin strap pad comprises a first half pad defining a first distinct piece of the two-piece chin strap pad and comprising a slot extending through the first half pad and a second half pad defining a second distinct piece of the two-piece chin strap pad and comprising a slot extending through the second half pad, and wherein the first half pad has a first perimeter defined by a first edge and a second edge, the first edge being curved and having a longer length than the second edge;

wherein the second half pad has a second perimeter defined by a third edge and a fourth edge, the third edge being curved and having a longer length than the fourth edge;

wherein, when the first half pad and the second half pad are attached to one another, the first edge and the third edge define an outer perimeter for the two-piece chin strap pad, and the second edge and the fourth edge being overlapped with one another in a direction transverse to a longitudinal length of the two-piece chin strap pad;

providing an attachment means for removably attaching said first half pad to said second half pad;

providing a helmet with a pair of chin straps;

providing a coupling member on each of said chin strap of the pair of chin straps;

sliding one chin strap of said pair of chin straps through said slot in said first half pad; and sliding another chin strap of said pair of chin straps through said slot in said second half pad.

4. The method set forth in claim 3, further comprising the steps of:

placing said helmet on a head of a wearer;

joining said coupling members together; and adjusting said first and second half pads so that each one is positioned between said pair of chin straps and a chin of said user.

5. The method set forth in claim 3, further comprising the step of:

removably attaching said first half pad to said second half pad.

6. The method set forth in claim 3, wherein said attachment means comprises hook and loop fastening material, wherein a first portion of said hook and loop fastening material is attached to said first half pad and a complementary second portion of said hook and loop fastening material is attached to said second half pad.

* * * * *